US010081455B2

(12) United States Patent
Clemence et al.

(10) Patent No.: US 10,081,455 B2
(45) Date of Patent: Sep. 25, 2018

(54) CONTAINER ASSEMBLY

(71) Applicants: Josh Clemence, Covington, IN (US); Noah Durham, Champaign, IL (US)

(72) Inventors: Josh Clemence, Covington, IN (US); Noah Durham, Champaign, IL (US)

(73) Assignee: EnvirOx, LLC, Danville, IL (US)

( * ) Notice: Subject to any disclaimer, the term of this patent is extended or adjusted under 35 U.S.C. 154(b) by 0 days.

(21) Appl. No.: 15/425,142

(22) Filed: Feb. 6, 2017

(65) Prior Publication Data

US 2017/0225837 A1 Aug. 10, 2017

Related U.S. Application Data

(60) Provisional application No. 62/291,573, filed on Feb. 5, 2016.

(51) Int. Cl.

| | |
|---|---|
| ***B65D 25/40*** | (2006.01) |
| ***B65D 1/02*** | (2006.01) |
| ***B65D 23/10*** | (2006.01) |
| ***B65D 1/40*** | (2006.01) |

(52) U.S. Cl.

CPC ..... *B65D 25/40* (2013.01); *B65D 1/023* (2013.01); *B65D 1/0207* (2013.01); *B65D 1/40* (2013.01); *B65D 23/10* (2013.01)

(58) Field of Classification Search

CPC ..... B65D 25/40; B65D 25/2882; B65D 25/2867; B65D 25/2826; B65D 25/2858; B65D 25/2802; B65D 23/10; B65D 1/40; B65D 1/023; B65D 1/0207; A47G 23/02

USPC ..... 222/465.1; 220/669, 771, 752; 215/40, 215/285, 396, 399; D9/528

See application file for complete search history.

(56) References Cited

U.S. PATENT DOCUMENTS

| | | | | |
|---|---|---|---|---|
| 3,397,724 | A | | 8/1968 | Bolen et al. |
| D244,991 | S | | 7/1977 | Weckman et al. |
| 4,125,632 | A | | 11/1978 | Vosti et al. |
| D259,405 | S | | 6/1981 | Drummond |
| D259,541 | S | | 6/1981 | Halbeisen et al. |
| 4,318,489 | A | | 3/1982 | Snyder et al. |
| 4,749,092 | A | | 6/1988 | Sugiura et al. |
| 4,865,206 | A | | 9/1989 | Behm et al. |
| D309,420 | S | | 7/1990 | Beaver |
| D311,136 | S | | 10/1990 | Barker et al. |
| D313,350 | S | | 1/1991 | Beaver |
| D329,816 | S | | 9/1992 | Beaver et al. |
| D331,195 | S | | 11/1992 | Weckman |
| D335,454 | S | | 5/1993 | McLean et al. |
| D350,484 | S | | 9/1994 | Addis et al. |
| D363,667 | S | | 10/1995 | Baratta-Dragono et al. |
| D366,421 | S | | 1/1996 | Best |
| D380,682 | S | * | 7/1997 | Robinson ..... D9/520 |
| D402,553 | S | | 12/1998 | Webster et al. |
| D409,495 | S | | 5/1999 | Hartman et al. |

(Continued)

*Primary Examiner* — Lien Ngo

(74) *Attorney, Agent, or Firm* — King & Partners, PLC

(57) ABSTRACT

A container assembly that is uniquely adapted to releasably engage a diluting dispenser and uniquely adapted for both handheld and wall mounted dispensing applications including a front wall, a left side wall, a right side wall, a back wall, a first top wall, wherein the first top wall is associated with a neck and a radial groove for releasably engaging a diluting dispenser, a second top wall having an angled handle associated therewith, a spout having an aperture, and a bottom wall.

17 Claims, 7 Drawing Sheets

(56) References Cited

U.S. PATENT DOCUMENTS

D420,918 S 2/2000 Hefter et al.
D430,798 S 9/2000 Stevens et al.
6,464,106 B1 * 10/2002 Giblin ..... B65D 1/0207 215/12.1
D472,151 S 3/2003 Warren et al.
D518,731 S 4/2006 Yourist et al.
D548,595 S 8/2007 Marasligiller et al.
D553,501 S 10/2007 Arnett et al.
D556,583 S 12/2007 Gurst et al.
D571,217 S 6/2008 Bates et al.
D573,884 S 7/2008 Crabtree et al.
D579,778 S 11/2008 De Gopegui et al.
D584,155 S 1/2009 Lorio
D595,137 S 6/2009 Bates et al.
D627,231 S 11/2010 Lee et al.
D637,916 S 5/2011 McNabb et al.
D643,297 S 8/2011 Lee et al.
D651,907 S 1/2012 Dennis et al.
D661,193 S 6/2012 Merchant et al.
D661,990 S * 6/2012 Lang ..... D9/528
D683,628 S 6/2013 Claassen
D684,061 S 6/2013 Leslie et al.
D685,642 S 7/2013 Leslie et al.
D686,080 S 7/2013 Tomkins et al.
D691,477 S 10/2013 Tomkins et al.
D696,128 S 12/2013 Lindsay et al.
D705,069 S 5/2014 Crisanti et al.
D714,647 S 10/2014 Kersten
D716,146 S 10/2014 Palmatier et al.
8,919,587 B2 12/2014 Howell et al.
D721,587 S 1/2015 Bos et al.
D723,927 S 3/2015 Fish et al.
D724,435 S 3/2015 Kaufman et al.
D730,190 S 5/2015 Lindsay et al.
D733,567 S 7/2015 Lindsay et al.
D736,637 S 8/2015 Castillo Higareda et al.
D739,247 S 9/2015 McDonnell
D739,749 S 9/2015 Bhattacharyya et al.
D741,183 S 10/2015 Cannamela et al.
D741,715 S 10/2015 Casscles et al.
D743,806 S 11/2015 Lang et al.
9,221,596 B2 * 12/2015 Patel ..... B65D 83/38
D763,698 S * 8/2016 Dunster ..... D9/575
2003/0155324 A1 * 8/2003 McCollum ..... B65D 1/0223 215/382
2004/0069736 A1 * 4/2004 Peronek ..... B65D 1/023 215/42
2005/0139609 A1 6/2005 Giblin et al.
2007/0045222 A1 3/2007 Denner et al.
2007/0210123 A1 9/2007 Penny et al.
2012/0267381 A1 10/2012 Trude et al.

* cited by examiner

CONTAINER ASSEMBLY

CROSS-REFERENCE TO RELATED APPLICATIONS

This application claims the benefit of U.S. Provisional Application Ser. No. 62/291,573, filed Feb. 5, 2016, entitled "Container Assembly," which is hereby incorporated herein by reference in its entirety—including all references and appendices cited therein.

BACKGROUND OF THE INVENTION

1. Field of the Invention

The present invention relates in general to containers and, more particularly, to container assemblies that comprise one or more components or sub-assemblies that are uniquely adapted to releasably engage a diluting dispenser as disclosed herein. The present invention further relates to container assemblies that are uniquely adapted for both hand-held and wall mounted dispensing applications.

2. Background Art

Container assemblies and their sub-assemblies have been known in the art for years and are the subject of a plurality of patents and publications, including: U.S. Pat. No. 8,919,587 entitled "Plastic Container with Angular Vacuum Panel and Method of Same," U.S. Pat. No. 4,865,206 entitled "Blow Molded One-Piece Bottle," U.S. Pat. No. 4,749,092 entitled "Saturated Polyester Resin Bottle," U.S. Pat. No. 4,318,489 entitled "Plastic Bottle," U.S. Pat. No. 4,125,632 entitled "Container," U.S. Pat. No. 3,397,724 entitled "Thin-Walled Container and Method of Making the Same," United States Patent Application Publication Number 2012/0267381 entitled "Container," United States Patent Application Publication Number 2007/0210123 entitled "Container Having Blown Pour Spout," United States Patent Application Publication Number 2007/0045222 entitled "Rectangular Container," United States Patent Application Publication Number 2005/0139609 entitled "Pour Spout Fitment and Container," U.S. Pat. No. D741,715 S entitled "Container," U.S. Pat. No. D686,080 S entitled "Bottle," U.S. Pat. No. D627,231 S entitled "Container," U.S. Pat. No. D584,155 S entitled "Bottle," and U.S. Pat. No. D548,595 S entitled "Bottle,"—all of which are hereby incorporated herein by reference in their entirety including all references cited therein.

U.S. Pat. No. 8,919,587 appears to disclose a plastic container having sidewall portions, and methods of manufacturing the same. The sidewall portion can accommodate a vacuum in a filled and sealed container and includes a plurality of columns extending between upper and lower ends of the sidewall portion, and a plurality of vacuum panels oriented vertically between respective adjacent ones of the columns, each vacuum panel including an upper section, a middle section, and a lower section, a first hinge connecting the upper and middle sections, and a second hinge connecting the middle and lower sections. The vacuum panels can move radially inward toward a container central axis such that the container vacuum is accommodated. As the vacuum panel moves radially inward, the middle section can maintain a substantially parallel orientation with respect to the central axis, and the upper and lower sections rotate about first and second hinges, respectively, and incline away from the central axis.

U.S. Pat. No. 4,865,206 appears to disclose a one-piece self-supporting blow molded plastic container having a generally cylindrical side wall and a bottom wall which extends downwardly and inwardly from the side wall. A plurality of wall portions extend downwardly from the bottom wall forming hollow legs extending below the bottom wall having planar feet which are inclined upwardly and inwardly from the outer edges of the feet. When filled, the bottom wall deflects downwardly and the inclined feet are moved into substantially horizontal positions such that the feet define a substantially flat supporting surface engaging area for the container.

U.S. Pat. No. 4,749,092 appears to disclose a saturated polyester resin bottle made thin by biaxial orientation and comprising a trunk portion formed to have a regular polygonal cross section consisting of a plurality of generally upright flat sides separated by vertically oriented ribs. When the interior of the bottle is subjected to a vacuum, the flat sides uniformly warp radially inwardly to accommodate the vacuum without detracting from the appearance of the bottle.

U.S. Pat. No. 4,318,489 appears to disclose a plastic bottle for holding liquids such as carbonated beverages under pressure. The bottle, a one-piece, self-standing biaxially-oriented plastic container, is generally cylindrical in body configuration with a spherical bottom from which several lobes or feet extend for supporting the bottle upright on a surface. The feet are also spherical in configuration and extend downwardly from the container bottom adjacent to the sidewall of the cylindrical body to support the bottle in a more stable upright position. The center of the bottom of the bottle may be depressed inwardly into the bottle to increase the clearance between the bottom and a surface on which the bottle stands. The configuration of the bottle serves to impart adequate strength and good resistance to eversion. The bottle can be made with a minimal amount of plastic for given performance characteristics, and at speeds that are economical, even for relatively small bottles.

U.S. Pat. No. 4,125,632 appears to disclose a plastic body for use in a container which is adapted to hold product under vacuum, without undesirable deformation of the container. The body has a curvilinear bulge at the base of its cylindrical sidewall, and the bulge is dimensioned and configured to permit its slight deflection under vacuum which, in turn, facilitates upward movement of the bottom wall of the body. These changes effect a reduction of volume within the body, thereby reducing the level of vacuum which forms therewithin. The characteristics of the body render it particularly well-suited for production in relatively small sizes, utilizing relatively rigid synthetic resinous materials. It is also especially adapted for use in connection with a metal end closure, which may be hermetically sealed thereonto.

U.S. Pat. No. 3,397,724 appears to disclose a thin-walled container made from a yieldable material, for example, of a plastic material, that is preformed with walls bulged to a shape such that upon filling the container and allowing it to stand, bulging, which would have occurred had the container been made with planar walls, is substantially reduced or limited. The container is suitable for use to contain milk and is generally of square-type.

United States Patent Application Publication Number 2012/0267381 appears to disclose a container forming assembly and method that includes receiving a parison within a cavity of a mold, enclosing the parison within the mold having a wall with a recess, inflating the parison in the mold to form a blow molded container where the blow molded container has a sidewall, a movable region formed at the recess, and a hinge circumscribing an interface between the sidewall and the movable region, and moving or repositioning the movable region toward an interior of the blow molded container about the hinge before filling. The movable region can form a deep-set grip.

United States Patent Application Publication Number 2007/0210123 appears to disclose a one-piece plastic container that includes a body defining a longitudinal axis. The body includes an upper portion, a sidewall portion and a base portion. The upper portion includes a spout defining an opening into the container. The sidewall portion is integrally formed with and extends from the upper portion to the base portion. The base portion closes off an end of the container. The spout extends at an angle relative to the longitudinal axis.

United States Patent Application Publication Number 2007/0045222 appears to disclose a blow molded plastic container that has a body section having a substantially non-circular cross-sectional shape, the body section having an enclosed bottom portion that forms a bottom end of the container and substantially flat side portions extending upwardly from the bottom end; a finish defining an opening; and a dome extending from the body section to the finish. The dome includes at least one stiffening structure formed by an inwardly indented, vertically extending groove.

United States Patent Application Publication Number 2005/0139609 appears to disclose a pour spout fitment that has an enlarged spout opening thereby making it less susceptible to double pouring and advantageous for dispensing new flowable product forms, such as gels. The pour spout opening is large relative to the bottle opening which is equated with the fitment's circumscribing wall. Accordingly, the pour spout fitment is less susceptible to double pouring and may also be useful for pouring more viscous product forms such as gels.

While the above-identified patents and publications do appear to disclose container assemblies, their configurations remain non-desirous and/or problematic inasmuch as, among other things, none of the above-identified container assemblies appear to be uniquely adapted to releasably engage a diluting dispenser in the novel manner disclosed herein. Furthermore, none of the above-identified container assemblies appear to be uniquely adapted for both handheld and wall mounted dispensing applications.

It is therefore an object of the present invention to provide a container assembly that is uniquely adapted to releasably engage a diluting dispenser as disclosed herein, namely; wherein the front wall of the container is flush or substantially flush with an adjacent vertical wall and/or a vertically disposed wall of the diluting dispenser when the neck and radial groove of the container assembly are mounted/connected to the diluting dispenser. It is therefore a further object of the present invention to provide a container assembly that is uniquely and ergonomically adapted for both handheld and wall mounted dispensing applications.

These and other objects of the present invention will become apparent in light of the present specification, claims, and drawings.

SUMMARY OF THE INVENTION

The present invention is directed to, in one embodiment, a one-piece, self-standing container assembly that is adapted to releasably engage a diluting dispenser, comprising, consisting essentially of and/or consisting of: (1) a front wall, wherein the front wall is preferably generally planar and comprises an upper end and a lower end; (2) a first left side wall and a second left side wall having a concave transitional step positioned therebetween, wherein the first and second left side walls each comprise an upper end and a lower end, and wherein the second left side wall is preferably generally planar; (3) a first right side wall and a second right side wall having a concave transitional step positioned therebetween, wherein the first and second right sidewalls each comprise an upper end and a lower end, and wherein the second right side wall is preferably generally planar; (4) a back wall, wherein the back wall is preferably generally planar and comprises an upper end and a lower end; (5) a first top wall, wherein the first top wall is preferably generally convex; (6) a neck, wherein the neck is preferably octagonal and positioned at least partially above the first top wall; (7) a radial groove positioned below the neck for releasably engaging a diluting dispenser, wherein the peripheral geometry of the radial groove is less than the peripheral geometry of the neck; (8) a spout having an aperture, wherein the spout is positioned above the neck; (9) a second top wall, wherein the second top wall forms an obtuse angle with the back wall; (10) a handle positioned in a spaced apart relationship from the second top wall to form an aperture therebetween, wherein the aperture is adapted to contain one or more fingers of a user; and (11) a bottom wall.

The present invention is also directed to a container assembly, comprising, consisting essentially of and/or consisting of: (1) a front wall; (2) a back wall; (3) a left side wall; (4) a right side wall; (5) a bottom wall; (6) a first top wall; (7) a neck, wherein the neck is preferably octagonal and positioned at least partially above the first top wall, wherein the neck preferably includes eight arcuate side walls; (8) a radial groove positioned below the neck for releasably engaging a diluting dispenser, wherein the peripheral geometry of the radial groove is less than the peripheral geometry of the neck; (9) a spout having an aperture, wherein the spout is positioned above the neck; (10) a second top wall, wherein the second top wall forms an obtuse angle with the back wall; and (11) a handle positioned in a spaced apart relationship from the second top wall to form an aperture therebetween, wherein the aperture is adapted to contain one or more fingers of a user.

The present invention is further directed to a container assembly that is adapted to releasably engage a diluting dispenser, comprising, consisting essentially of and/or consisting of: (1) a front wall, wherein the front wall comprises an upper end and a lower end; (2) a first left side wall and a second left side wall having a transitional step positioned therebetween, wherein the first and second left side walls each comprise an upper end and a lower end; (3) a first right side wall and a second right side wall having a transitional step positioned therebetween, wherein the first and second right side walls each comprise an upper end and a lower end; (4) a back wall, wherein the back wall comprises an upper end and a lower end; (5) a first top wall; (6) a neck positioned at least partially above the first top wall; (7) a radial groove positioned below the neck for releasably engaging a diluting dispenser, wherein the peripheral geometry of the radial groove is less than the peripheral geometry of the neck; (8) a spout having an aperture, wherein the spout is positioned above the neck; (9) a second top wall; (10) a handle positioned in a spaced apart relationship from the second top wall to form an aperture therebetween, wherein the aperture is adapted to contain one or more fingers of a user; and (11) a bottom wall.

In a preferred embodiment of the present invention, the container assembly is fabricated from a thermoplastic resin.

In another preferred embodiment of the present invention, the container assembly is fabricated from at least one of an aliphatic polyamide and a semi-aromatic polyamide.

In yet another preferred embodiment of the present invention, the container assembly is fabricated from at least one of a polyethylene, a high-density polyethylene, a polycarbonate, an acrylonitrile butadiene styrene, a copolyester, a polystyrene, a high impact polystyrene, and a polyphenylene oxide.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be further understood that the invention is not necessarily limited to the particular embodiments illustrated herein.

The invention will now be described with reference to the drawings wherein.

DETAILED DESCRIPTION OF THE INVENTION

Figure 1:
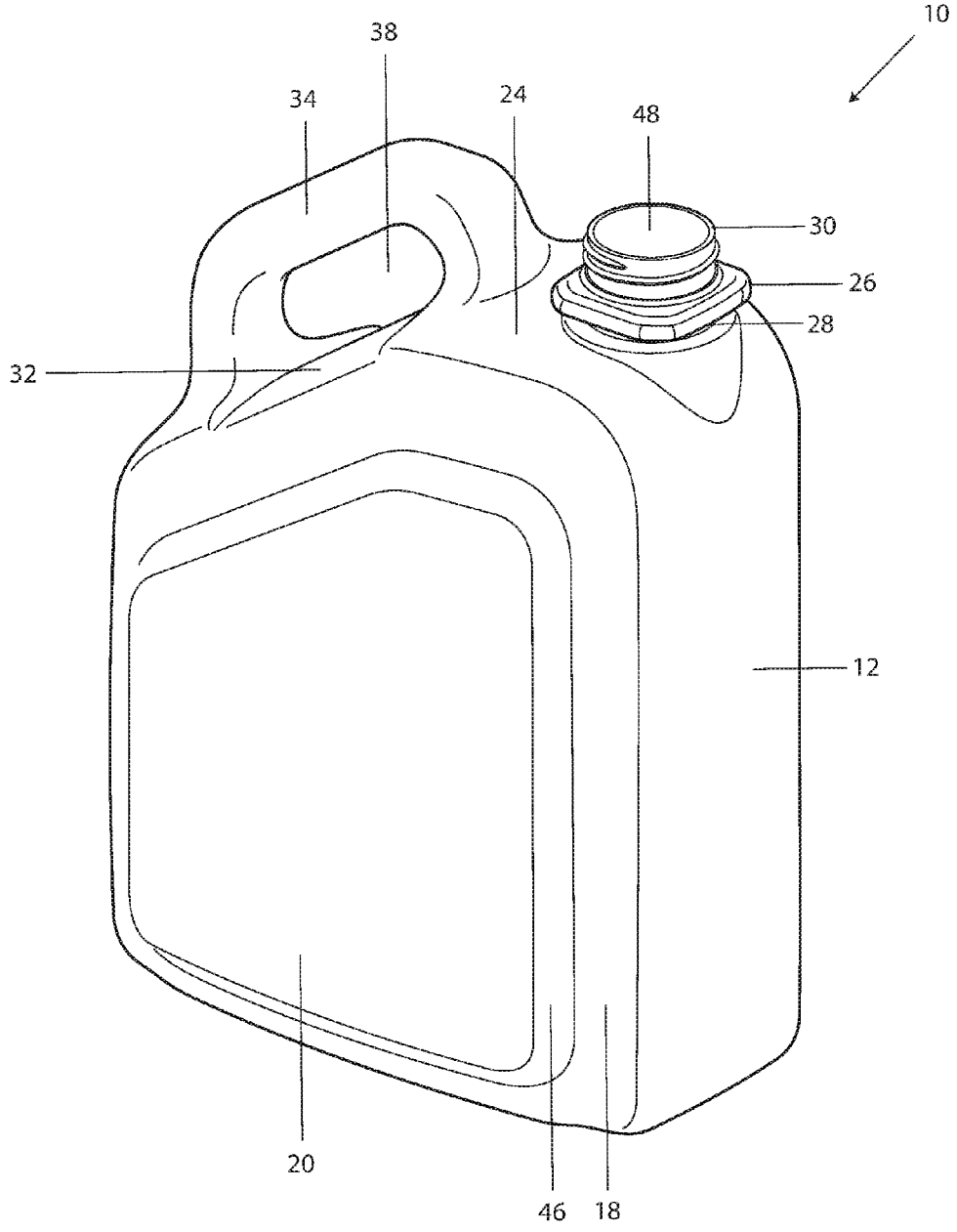
FIG. 1 is an isometric view of a container assembly manufactured in accordance with the present invention.

While this invention is susceptible of embodiment in many different forms, there is disclosed and described herein in detail specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of one or more embodiments of the invention, and some of the components may have been distorted from their actual scale for purposes of pictorial clarity.

In accordance with the present invention, the container assemblies are preferably one-piece (excluding the cap) and self-standing. These containers are adapted to releasably engage a diluting dispenser in a unique manner wherein the front wall of the container is flush or substantially flush with an adjacent vertical wall and/or a vertically disposed wall of the diluting dispenser when the neck and radial groove of the container assembly are mounted/connected to the diluting dispenser. These containers are also uniquely and ergonomically adapted for both handheld and wall mounted dispensing applications.

Referring now to the drawings and collectively to FIGS. 1-6, container assembly 10 is shown, which generally comprises front wall 12, first left side wall 14, second left side wall 16, first right side wall 18, second right side wall 20, back wall 22, first top wall 24, neck 26, radial groove 28, spout 30, second top wall 32, handle 34, bottom wall 36, and aperture 38. It will be understood that collectively the bottom wall, front wall, back wall, side walls, and top walls are spaced apart from one another to define a containment region for containing product (e.g., a liquid, a semi-solid, a solid) such as, but not limited to, consumable products, residential, commercial, and/or industrial cleaning products, etcetera.

Figure 3:
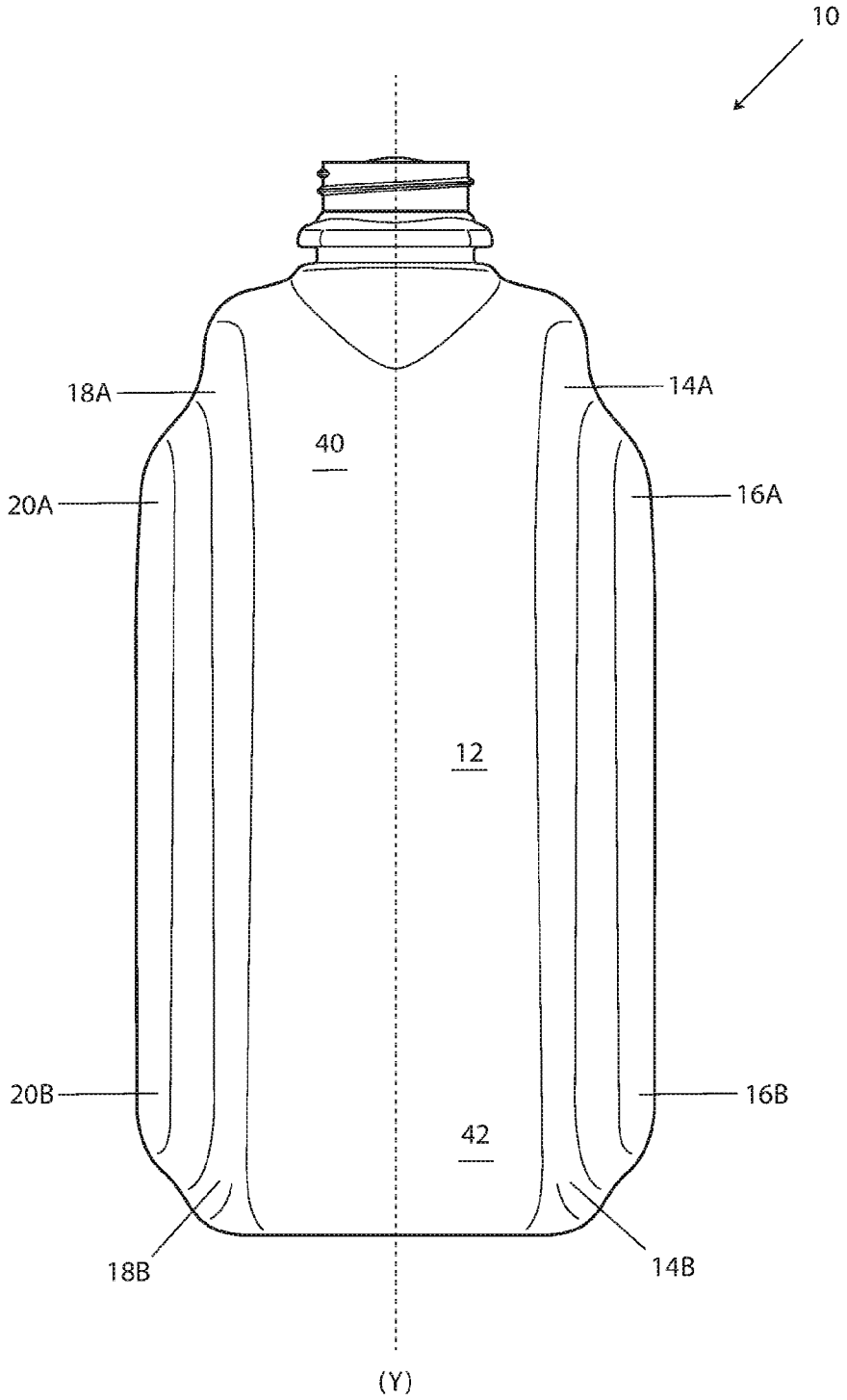
FIG. 3 is a front end view of the container assembly of FIG. 1.

Referring now to FIG. 3, front wall 12 is preferably generally planar and comprises upper end 40 and lower end 42. As is shown in FIG. 3, container assembly 10 exhibits symmetry along axis (Y) which generally corresponds to the vertical mid-point of front wall 12.

Figure 2:
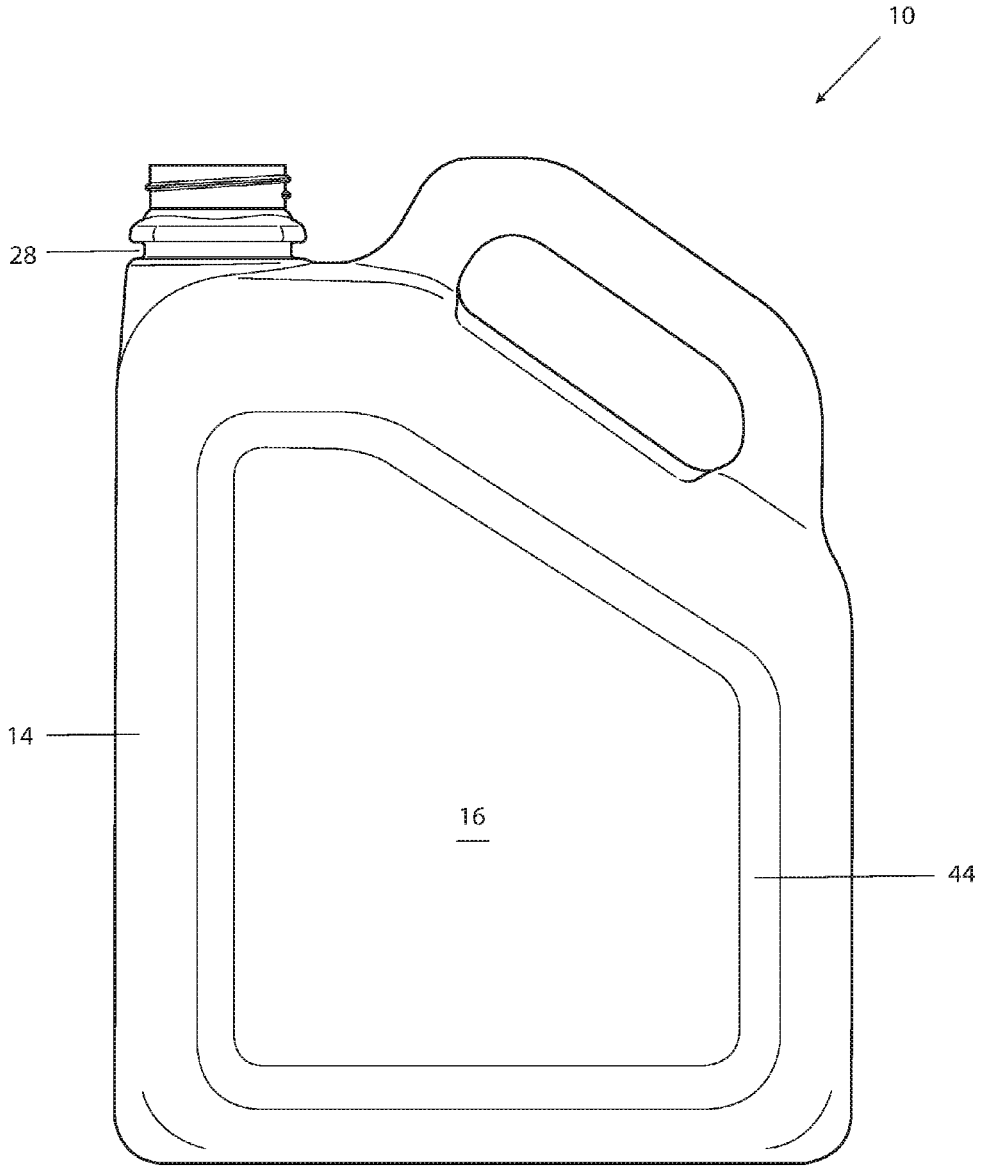
FIG. 2 is a left side view of the container assembly of FIG. 1. It will be understood that a right side view is a mirror image of the left side view.

As is best shown in FIGS. 2-3 first left side wall 14 and second left side wall 16 include concave transitional step 44 positioned therebetween. The first and second left side walls comprise upper ends 14A and 16A, respectively, and lower ends 14B and 16B, respectively. In one embodiment, second left side wall 16 is generally planar.

Referring once again to FIG. 1, first right side wall 18 and second right side wall 20 include concave transitional step 46 positioned therebetween. The first and second right side walls comprise upper ends 18A and 20A, respectively, and lower ends 18B and 20B, respectively. In one embodiment, second right side wall 20 is generally planar.

Figure 4:
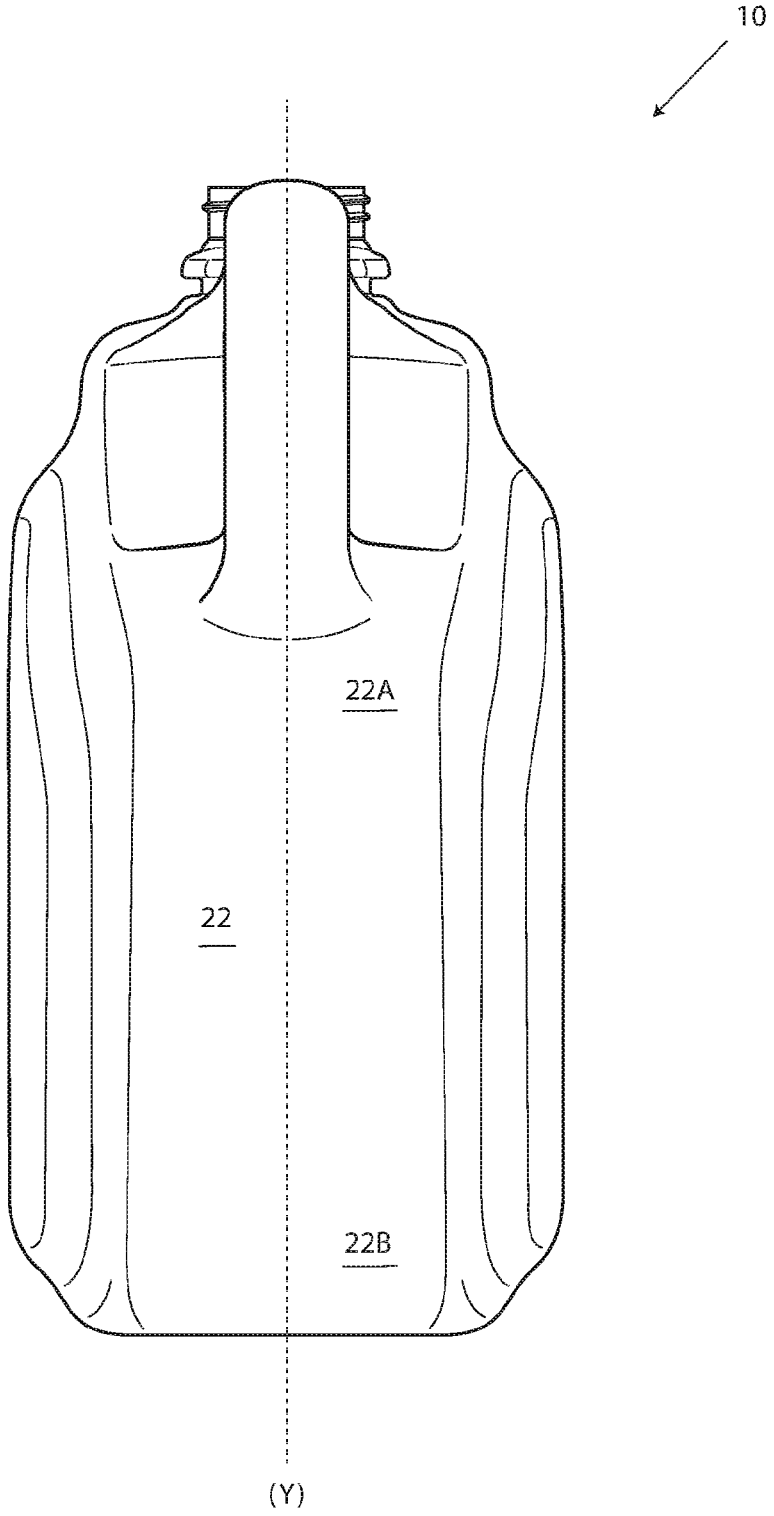
FIG. 4 is a rear end view of the container assembly of FIG. 1.

As is best shown in FIG. 4, back wall 22 includes upper end 22A and lower end 22B. Back wall 22 is preferably generally planar. A first portion of handle 34 originates proximate upper end 22A of back wall 22.

Figure 5A:
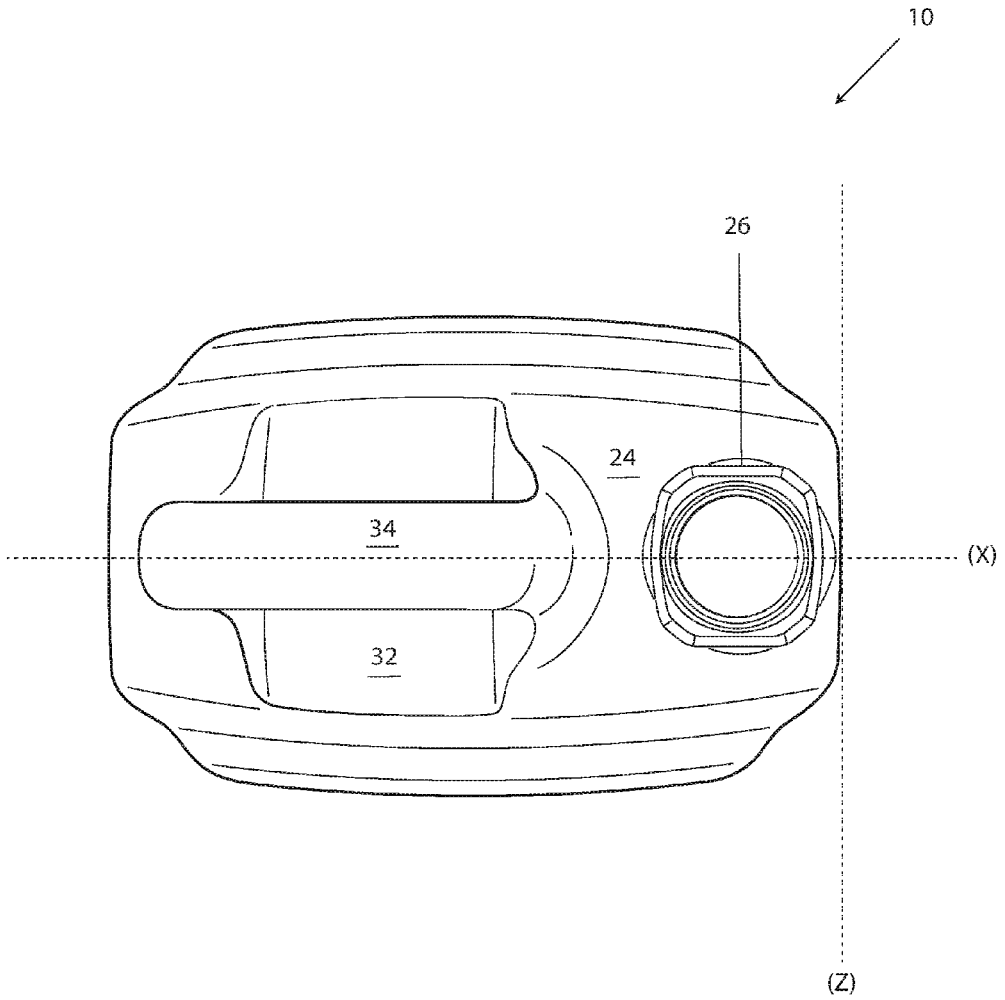
FIG. 5A is a top plan view of the container assembly of FIG. 1.
Figure 5B:
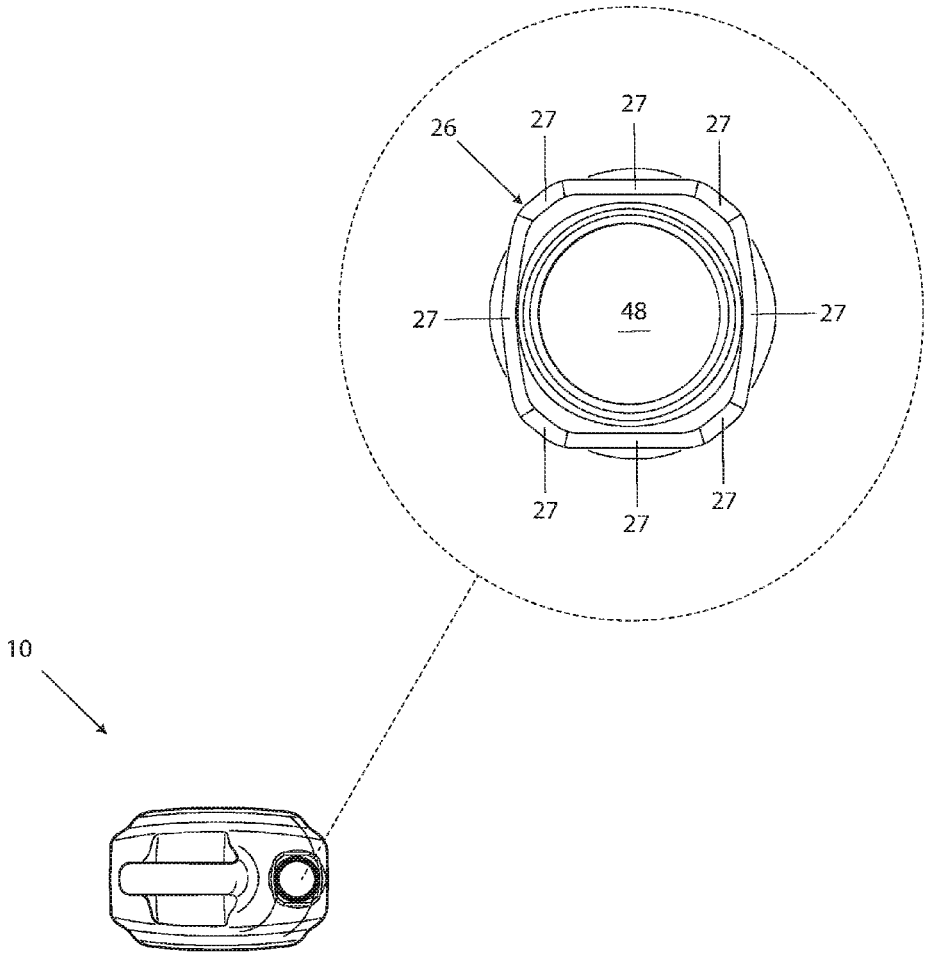
FIG. 5B is a magnified top plan view of the container assembly of FIG. 1 showing details of the neck and the spout.
Figure 6:
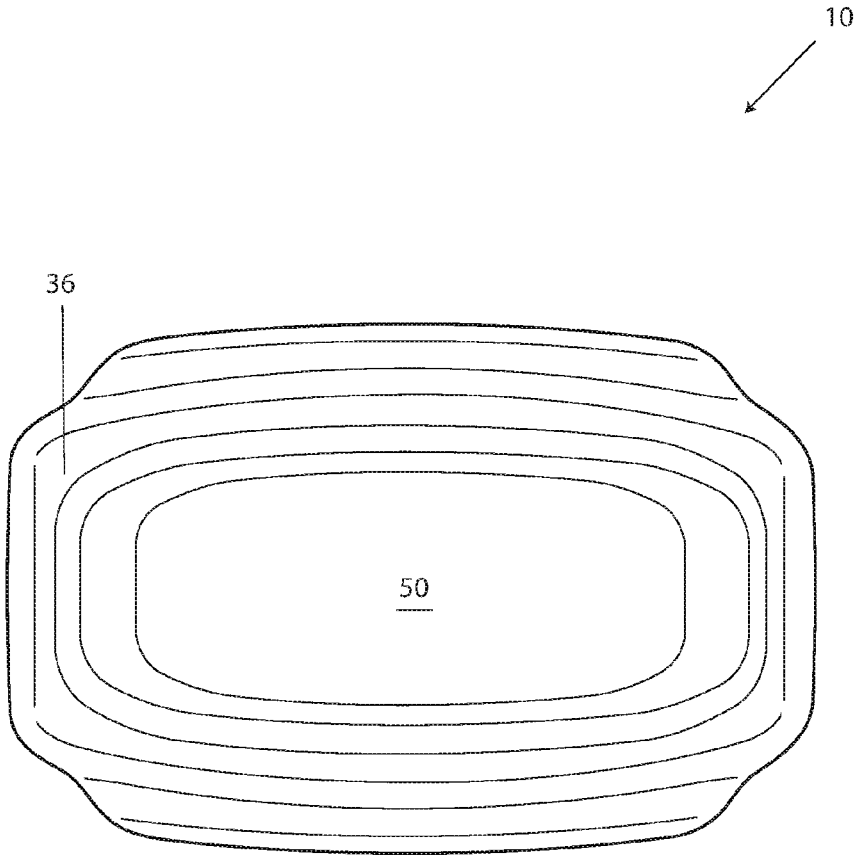
FIG. 6 is a bottom plan view of the container assembly of FIG. 1.

Referring now to FIGS. 1 and 5A, first top wall 24 is preferably generally flat and/or generally convex. A second portion of handle 34 originates proximate a rear end of top wall 24. As is shown in FIG. 5A, container assembly 10 exhibits symmetry along axis (X) which generally corresponds to the horizontal mid-point of top wall 24 and handle 34. As is further shown in FIGS. 1 and 5A, spout 30 (as well as neck 26 and radial groove 28) are offset from axis (Z) as well as front wall 12 so that front wall 12 of container assembly 10 is flush or substantially flush with an adjacent vertical wall and/or a vertically disposed wall of the diluting dispenser (not shown) when the neck and radial groove of the container assembly are mounted/connected to the diluting dispenser.

Referring once again to FIGS. 1-6 collectively, neck 26 is preferably octagonal and is positioned at least partially above first top wall 24. In one embodiment of the present invention, neck 26 includes eight arcuate side walls 27 (See FIG. 5B).

Radial groove 28 is positioned below neck 26 for releasably engaging a diluting dispenser. In one embodiment of the present invention, the peripheral geometry of the radial groove is less than the peripheral geometry of the neck.

Spout 30 is positioned above neck 26 and includes product aperture 48. During storage, spout 30 can be associated with a cap to prevent product from being contaminated and/or prevent product from spilling out of the container.

Referring now to FIGS. 1, 4, and 5A, second top wall 32 includes a generally planar surface. Second top wall 32 preferably forms an obtuse angle with back wall 22 (See FIG. 2).

Handle 34 is positioned in a spaced apart relationship from second top wall 32 to form aperture 38 therebetween. Aperture 38 is adapted to contain one or more fingers of a user. In one embodiment, handle 34 is angled relative to back wall 22 so that the user can ergonomically use and/or transport container assembly 10.

Bottom wall 36 enables container assembly 10 to be self-standing. Bottom wall 36 also preferably includes recessed region 50. It will be understood that, although not shown, bottom wall 36 and/or recessed region 50 can also include one more ground engaging feet.

In a preferred embodiment of the present invention, container assembly 10 is fabricated from a thermoplastic resin.

In another preferred embodiment of the present invention, container assembly 10 is fabricated from an aliphatic polyamide and/or a semi-aromatic polyamide.

In yet another preferred embodiment of the present invention, container assembly 10 is fabricated from one or more of a polyethylene, a high-density polyethylene, a polycarbonate, an acrylonitrile butadiene styrene, a copolyester, a polystyrene, a high impact polystyrene, and a polyphenylene oxide.

The foregoing description merely explains and illustrates the invention and the invention is not limited thereto except insofar as the appended claims are so limited, as those skilled in the art who have the disclosure before them will be able to make modifications without departing from the scope of the invention.

What is claimed and desired to be secured by Letters Patent of the United States is:

1. A one-piece, self-standing container assembly, consisting of:

a front wall, wherein the front wall is generally planar and comprises an upper end and a lower end;

a first left side wall and a second left side wall having a concave transitional step positioned therebetween, wherein the first and second left side walls each comprise an upper end and a lower end, and wherein the second left side wall is generally planar;

a first right side wall and a second right side wall having a concave transitional step positioned therebetween, wherein the first and second right sidewalls each comprise an upper end and a lower end, and wherein the second right side wall is generally planar;

a back wall, wherein the back wall is generally planar and comprises an upper end and a lower end;

a first top wall, wherein the first top wall is generally convex;

a neck, wherein the neck is octagonal and positioned at least partially above the first top wall;

a radial groove positioned below the neck, wherein the peripheral geometry of the radial groove is less than the peripheral geometry of the neck;

a spout having an aperture, wherein the spout is positioned above the neck;

a second top wall, wherein the second top wall forms an obtuse angle with the back wall;

a handle positioned in a spaced apart relationship from the second top wall to form an aperture therebetween, wherein the aperture is adapted to contain one or more fingers of a user, and wherein the handle is angled relative to the front wall; and a bottom wall.

2. A container assembly, comprising:

a front wall;

a back wall;

a left side wall;

a right side wall;

a bottom wall;

a first top wall;

a neck, wherein the neck is octagonal and positioned at least partially above the first top wall, wherein the neck includes eight arcuate side walls;

a radial groove positioned below the neck, wherein the peripheral geometry of the radial groove is less than the peripheral geometry of the neck;

a spout having an aperture, wherein the spout is positioned above the neck;

a second top wall, wherein the second top wall forms an obtuse angle with the back wall; and a handle positioned in a spaced apart relationship from the second top wall to form an aperture therebetween, wherein the aperture is adapted to contain one or more fingers of a user, wherein the handle is angled relative to the front wall, and wherein the handle includes a top wall positioned above both the neck and the spout.

3. A container assembly, comprising:

a front wall, wherein the front wall comprises an upper end and a lower end;

a first left side wall and a second left side wall having a transitional step positioned therebetween, wherein the first and second left side walls each comprise an upper end and a lower end, and wherein the first and second left side walls are orthogonal to the front wall;

a first right side wall and a second right side wall having a transitional step positioned therebetween, wherein the first and second right side walls each comprise an upper end and a lower end, and wherein the first and second right side walls are orthogonal to the front wall;

a back wall, wherein the back wall comprises an upper end and a lower end;

a first top wall;

a neck positioned at least partially above the first top wall;

a radial groove positioned below the neck, wherein the peripheral geometry of the radial groove is less than the peripheral geometry of the neck;

a spout having an aperture, wherein the entire spout is positioned above the neck;

a second top wall;

a handle positioned in a spaced apart relationship from the second top wall to form an aperture therebetween, wherein the aperture is adapted to contain one or more fingers of a user, wherein the handle is angled relative to the front wall, and wherein the handle includes a top wall positioned above both the neck and the spout; and a bottom wall.

4. The container assembly according to claim 3, wherein the front wall is generally planar.

5. The container assembly according to claim 4, wherein the transitional step positioned between the first left side wall and the second left side wall is concave.

6. The container assembly according to claim 5, wherein the second left side wall is generally planar.

7. The container assembly according to claim 6, wherein the transitional step positioned between the first right side wall and the second right side wall is concave.

8. The container assembly according to claim 7, wherein the second right side wall is generally planar.

9. The container assembly according to claim 8, wherein the back wall is generally planar.

10. The container assembly according to claim 9, wherein the first top wall is generally convex.

11. The container assembly according to claim 10, wherein the neck is octagonal.

12. The container assembly according to claim 11, wherein the neck comprises at least one arcuate side wall.

13. The container assembly according to claim 12, wherein the neck comprises eight arcuate side walls.

14. The container assembly according to claim 13, wherein the container assembly comprises one-piece and is self-standing.

15. The container assembly according to claim 14, wherein the container assembly is fabricated from a thermoplastic resin.

16. The container assembly according to claim 14, wherein the container assembly is fabricated from at least one of an aliphatic polyamide and a semi-aromatic polyamide.

17. The container assembly according to claim 14, wherein the container assembly is fabricated from at least one of a polyethylene, a high-density polyethylene, a polycarbonate, an acrylonitrile butadiene styrene, a copolyester, a polystyrene, a high impact polystyrene, and a polyphenylene oxide.

* * * * *